US005875692A

United States Patent [19]

Lin

[11] Patent Number: 5,875,692

[45] Date of Patent: Mar. 2, 1999

[54] RATCHET SCREW DRIVER

[76] Inventor: Ching Chou Lin, No. 150, Sec. 3, Chung San Road, Wu Zh Hsiang, Taichung Hsien, Taiwan

[21] Appl. No.: 899,120

[22] Filed: Jul. 23, 1997

[51] Int. Cl.[6] ..... B25B 13/46

[52] U.S. Cl. ..... 81/58.3; 81/177.4; 81/490; 192/48.92

[58] Field of Search ..... 81/58, 58.1, 58.3, 81/58.4, 60, 63.1, 437–439, 177.4, 490; 192/48.92, 43, 45.2, 46, 48.1

[56] References Cited

U.S. PATENT DOCUMENTS

| | | | |
|---|---|---|---|
| 122,916 | 1/1872 | Sanborn | 81/58.3 |
| 1,440,123 | 12/1922 | Anderson | 81/58.3 |
| 1,553,850 | 9/1925 | Davis | 81/58.3 |
| 1,627,441 | 5/1927 | Lawyer | 81/58.3 |
| 2,292,228 | 8/1942 | Krieger | 81/58.3 |
| 2,393,413 | 1/1946 | Rober | 81/58.3 |

FOREIGN PATENT DOCUMENTS

| | | | |
|---|---|---|---|
| 577156 | 9/1924 | France | 81/58.3 |

*Primary Examiner*—D. S. Meislin
*Attorney, Agent, or Firm*—Charles E. Baxley, Esq.

[57] ABSTRACT

A ratchet screw driver includes a follower secured in a handle and having two ends each having a number of ratchet teeth. A barrel is engaged in the follower and has two non-circular ends for slidably engaging with two rings. The rings have ratchet teeth arranged opposite to each other for being biased to engage with that of the follower. The barrel may be rotated by the handle when the handle is rotated in an active direction, and the rings may be forced away from the follower against the biasing springs when the handle is rotated in a reverse direction.

4 Claims, 6 Drawing Sheets

RATCHET SCREW DRIVER

BACKGROUND OF THE INVENTION

1. Field of the Invention

The present invention relates to a screw driver, and more particularly to a ratchet screw driver.

2. Description of the Prior Art

Typical screw drivers comprise a driving shaft engaged in a handle for driving fasteners. A number of ratchet mechanisms are engaged in the handle for allowing the driving shaft to be rotated in an active direction and to be rotated freely in the opposite direction. However, the ratchet mechanism includes a complicated configuration. In addition, the tool bits may not be received in the handle in which the ratchet mechanism is engaged therein.

The present invention has arisen to mitigate and/or obviate the afore-described disadvantages of the conventional screw drivers.

SUMMARY OF THE INVENTION

The primary objective of the present invention is to provide a ratchet screw driver in which the driving shaft and the tool bits may be engaged in the handle where the ratchet mechanism is also received.

In accordance with one aspect of the invention, there is provided a ratchet screw driver comprising a handle including a bore and including a front portion and including a rear portion, a follower secured in the bore of the handle and rotated in concert with the handle, the follower including a puncture and including two ends each having a plurality of ratchet teeth, a barrel rotatably engaged in the puncture of the follower and including two ends each having a non-circular cross section, two rings each including a non-circular aperture for engaging with the non-circular ends of the barrel and for allowing the rings to be slidably engaged on the ends of the barrel and for allowing the rings to be rotated in concert with the barrel, the rings each including a plurality of ratchet teeth for engaging with the ratchet teeth of the ends of the follower respectively, the ratchet teeth of a first of the rings being arranged opposite to that of a second of the rings, means for biasing the rings toward the follower and for biasing the ratchet teeth of the rings to engage with the ratchet teeth of the follower, and an extension engaged with the barrel. The extension is adapted to be rotated by the handle when the handle is rotated in an active direction, and the rings are adapted to be forced away from the follower against the biasing means when the handle is rotated in a reverse direction.

The handle includes an open front and includes a cap secured to the front portion, the cap includes at least one cavity for engaging with a tool bit.

A member is further secured in the front portion of the handle, the front portion of the handle includes at least one rib, the member includes at least one groove for slidably engaging with the rib and for allowing the member to be slidably engaged in the handle and for allowing the member to be rotated in concert with the handle. The rib includes a notch, the cap includes a locking element for engaging with the notch and for securing the cap to the handle.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

A co-pending U.S. patent application was filed on Feb. 19, 1997, with the Ser. No. 08/802,093. The co-pending U.S. patent application is taken as a reference for the present invention.

Figure 1:
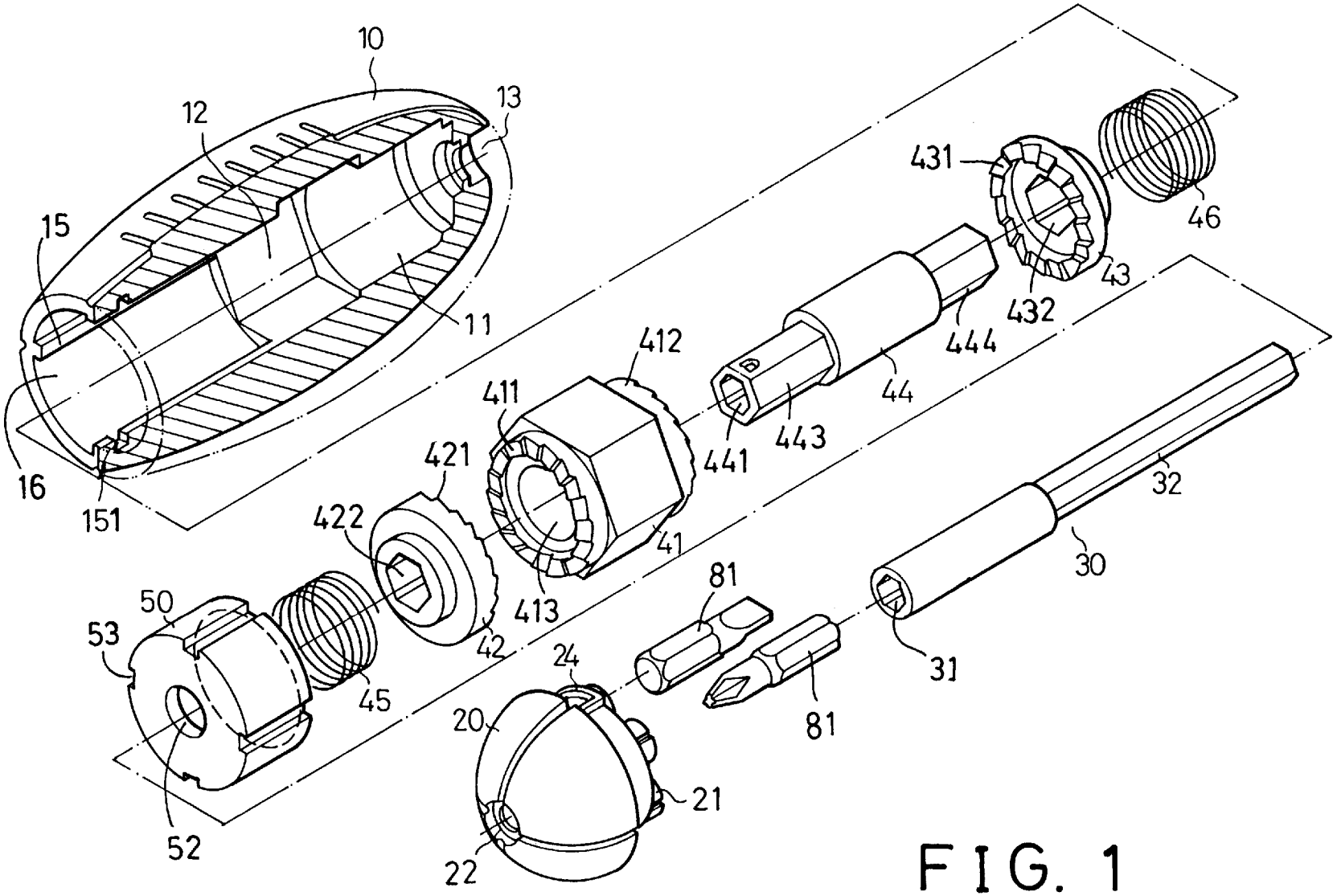
FIG. 1 is an exploded view of a ratchet screw driver in accordance with the present invention.
Figure 2:
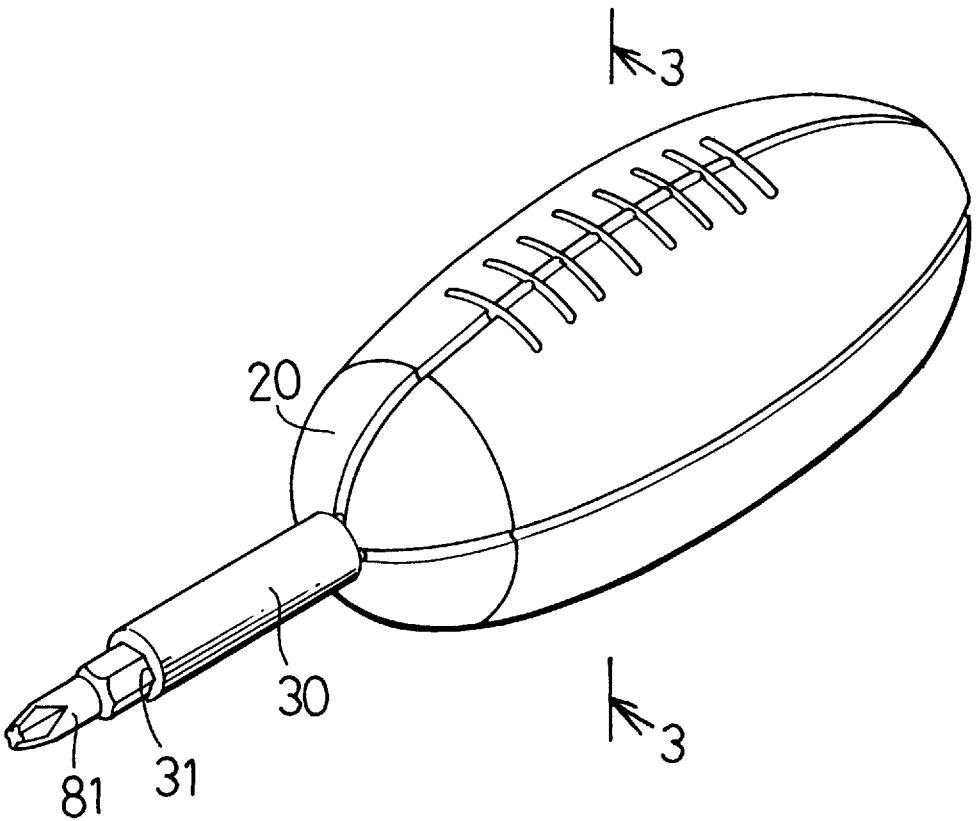
FIG. 2 is a perspective view of the ratchet screw driver.
Figure 3:
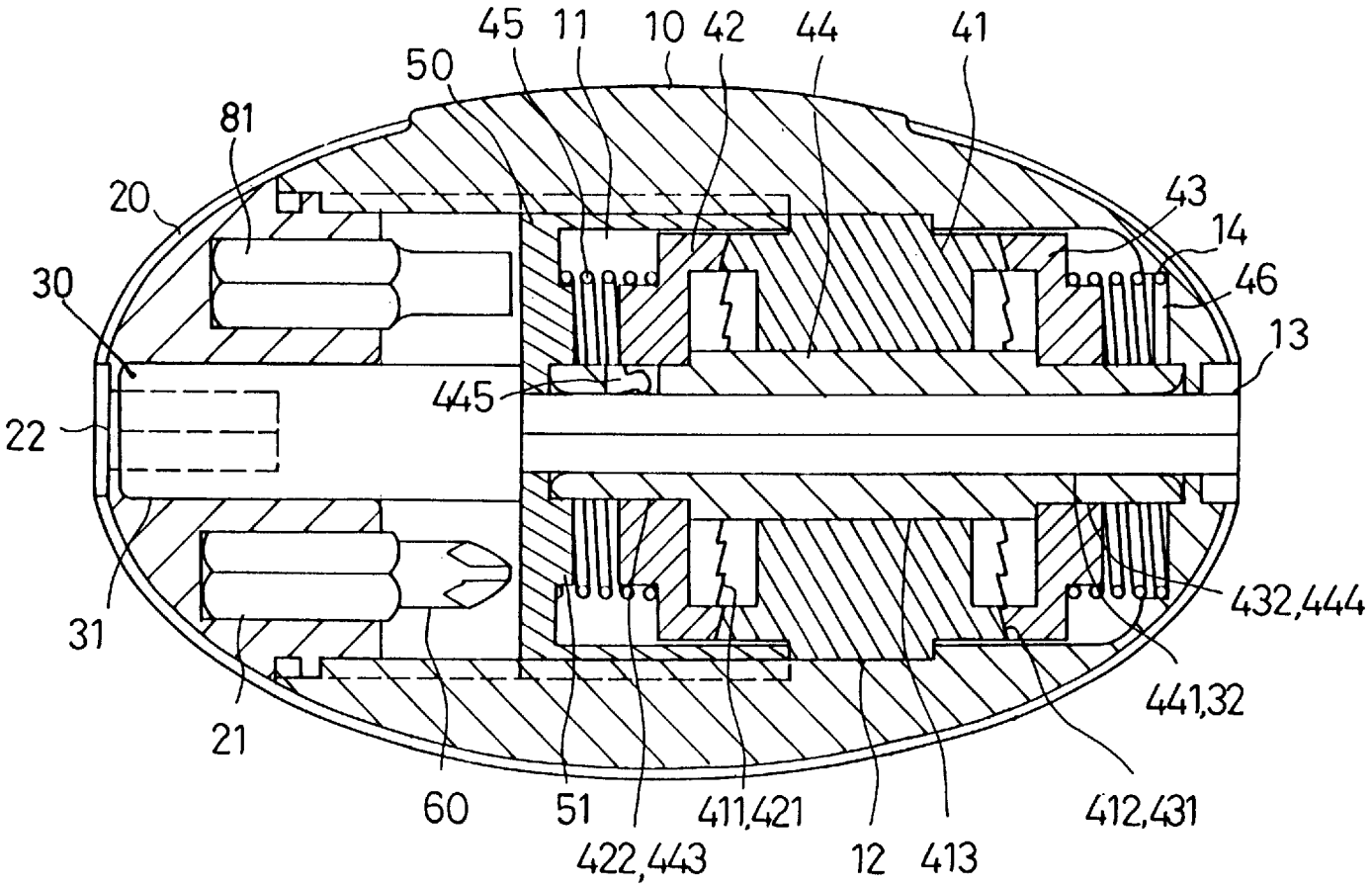
FIG. 3 is a cross sectional view taken along lines 3—3 of FIG. 2.

Referring to the drawings, and initially to FIGS. 1 to 3, a ratchet screw driver in accordance with the present invention comprises a handle 10 including a bore 11 and including an open front 16 and including an orifice 13 and an annular shoulder 14 formed in the rear portion and including a non-circular hole 12 formed in the center portion. One or more ribs 17 are longitudinally formed in the open front 16. One of the ribs 15 includes a notch 151 formed in the front portion. A cap 20 may be secured to the front portion of the handle 10 for enclosing the open front 16. The cap 20 includes a number of cavities 21 for engaging with tool bits 81 and for allowing the tool bits 81 to be engaged in the bore 11 of the handle 10. The cap 20 includes an orifice 22 formed in the center portion and includes an L-shaped locking member 24 formed on the outer peripheral portion for engaging with the notch 151 and for allowing the cap 20 to be secured to the handle 10.

A member 50 includes one or more grooves 53 for slidably engaging with the ribs 15 and for allowing the member 50 to be slidably engaged in the open front 16 of the handle 10 and for preventing the member 50 from rotating relative to the handle 10. The member 50 includes a hole 52 and includes a hub 51 (FIG. 3) formed in the inner portion for engaging with one end of a spring 45. A barrel 44 includes two ends 443, 444 each having a non-circular cross section and includes a non-circular bore 441 for engaging with a shaft 32 of an extension 30 which includes an opening 31 for engaging with a tool bit 81. Two rings 42, 43 are engaged in the bore 11 of the handle 10 and each includes a non-circular aperture 422, 432 for engaging with the non-circular ends 443, 444 of the barrel 44 such that the rings 42, 43 rotate in concert with the barrel 44 and such that the rings 42, 43 are allowed to move longitudinally along the ends 443, 444 of the barrel 44. The rings 42, 43 each includes a number of ratchet teeth 421, 431 facing toward each other. The directions of the ratchet teeth 421, 431 are arranged opposite to each other.

A follower 41 includes a puncture 413 rotatably engaged on the barrel 44 and includes a non-circular cross section for engaging with the non-circular hole 12 of the handle 10 such that the follower 41 may slide along the barrel 44 and may rotate in concert with the handle 10. The follower 41 includes two ends each having a number of ratchet teeth 411, 412 for engaging with the ratchet teeth 421, 431 of the rings 42, 43. Two springs 45, 46 are engaged with the rings 42, 43 for biasing the ratchet teeth 421, 431 of the rings 42, 43 to engage with the ratchet teeth 411, 412 of the follower 41.

Figure 5:
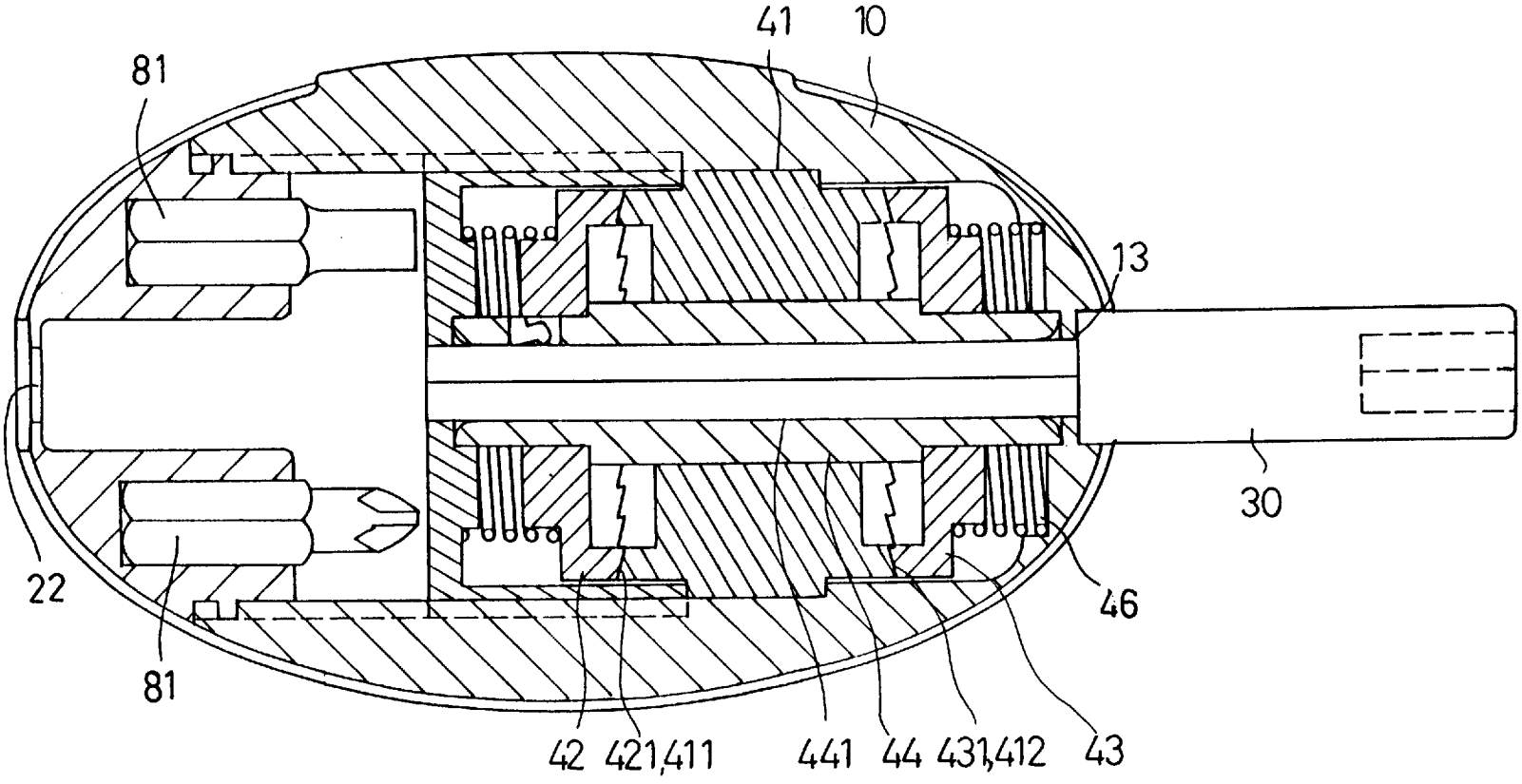
Figure 6:
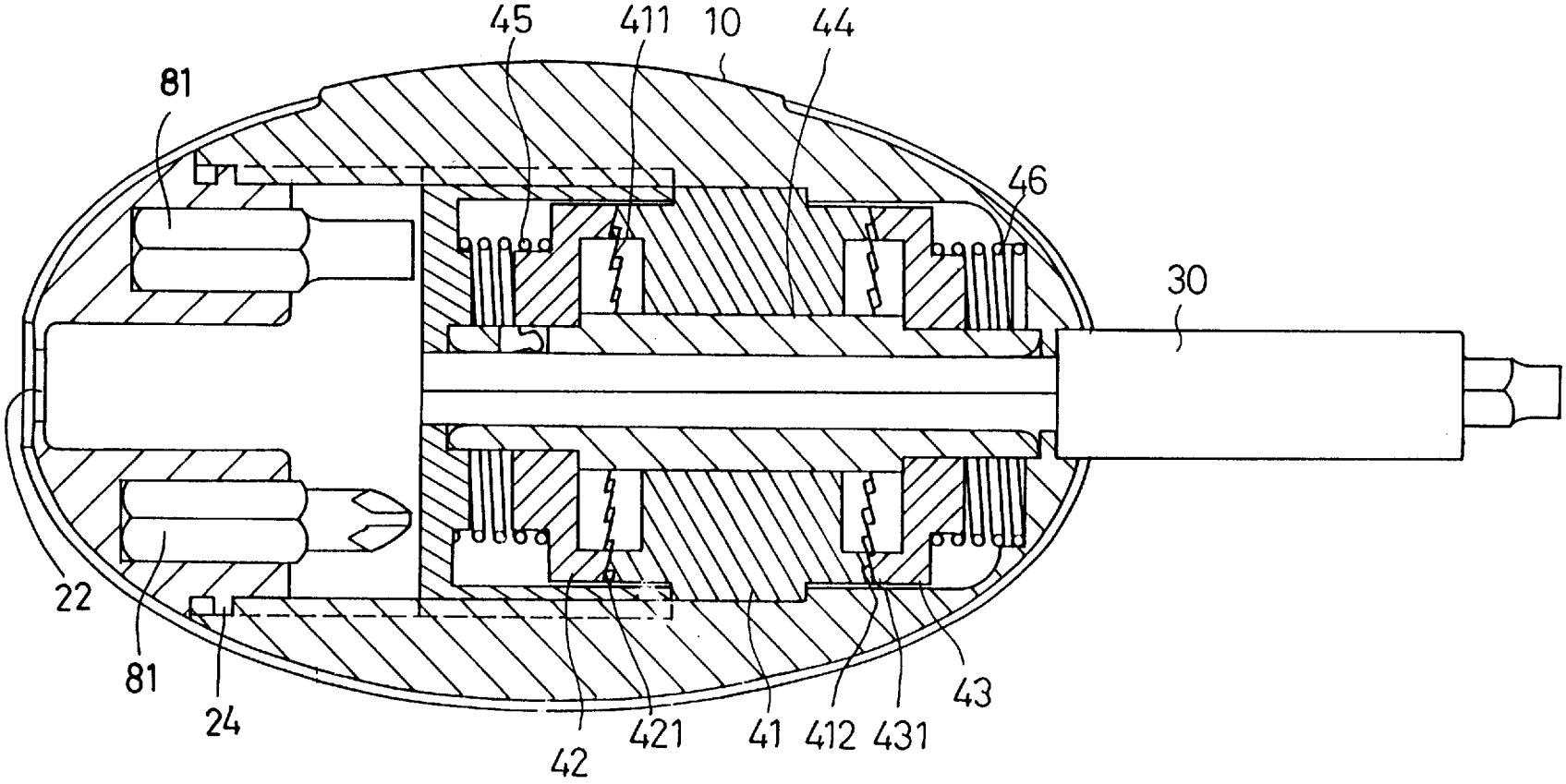

In operation, as shown in FIGS. 5 and 6, the shaft 32 of the extension 30 may engage with the barrel 44 via the orifice 13 of the handle 10. When the handle 10 is rotated in one direction, the shaft 32 may be rotated by the handle 10 (FIG. 5). However, the rings 42, 43 may be forced away from the follower 41 against the springs 45, 46 when the handle is rotated in the reverse direction such that the shaft

Figure 4:
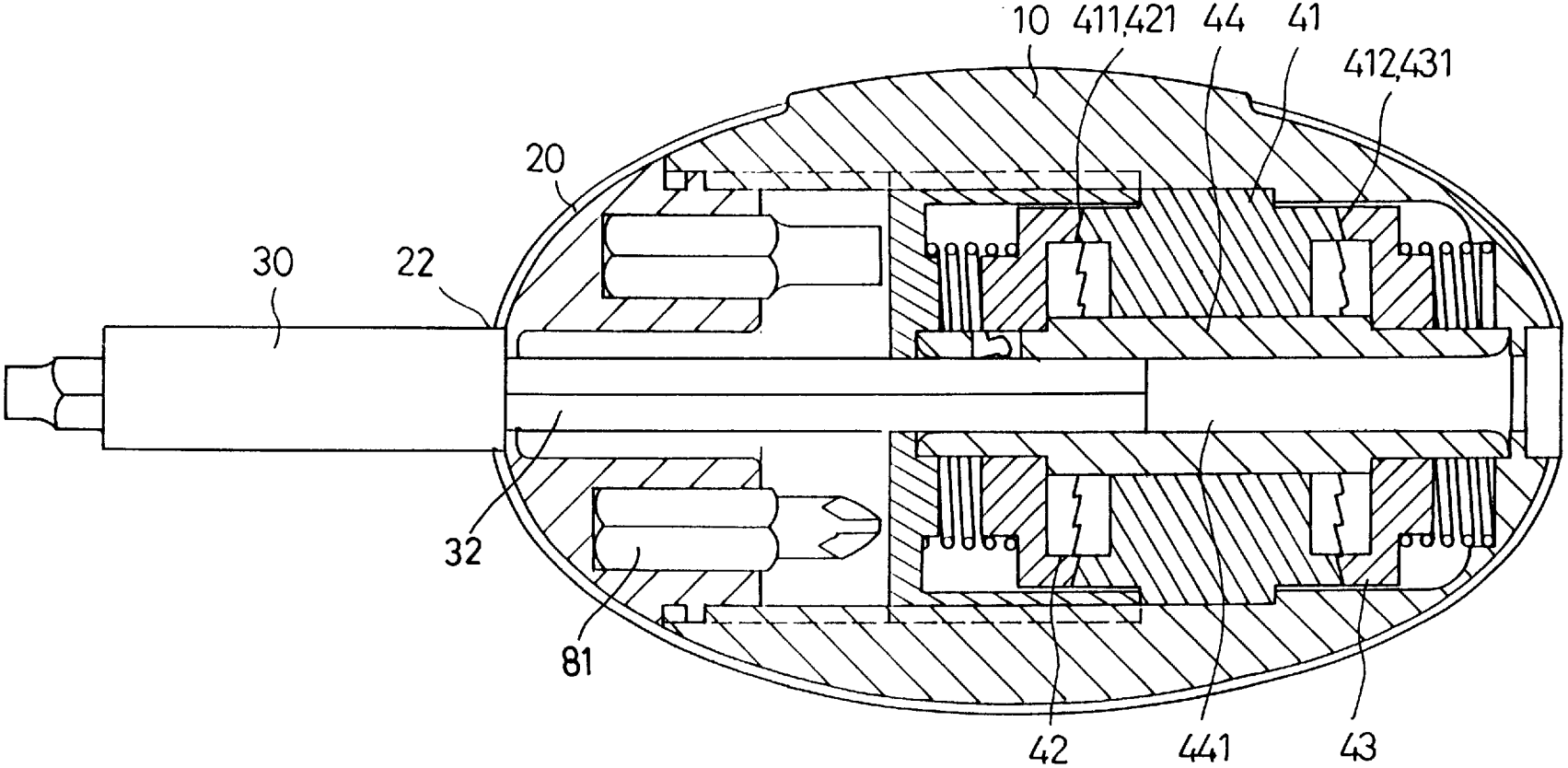
FIGS. 4, 5, 6 are cross sectional views similar to FIG. 3, illustrating the operation of the ratchet screw driver.

32 may not be rotated by the handle in the reverse direction. As shown in FIG. 4, when the shaft 32 is engaged with the barrel 44 via the orifice 22 of the cap 20, the active driving direction of the shaft 32 is different from that shown in FIGS. 5 and 6. As shown in FIG. 3, the extension 30 may be received in the handle 10 and the cap 20 so as to form a compact configuration.

Accordingly, the ratchet screw driver in accordance with the present invention includes a driving shaft and a number of tool bits that may be engaged in the handle where the ratchet mechanism is received.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet screw driver comprising:

a handle including a bore and including a front portion and including a rear portion, a follower secured in said bore of said handle and rotated in concert with said handle, said follower including a puncture and including two ends each having a plurality of ratchet teeth, a barrel rotatably engaged in said puncture of said follower and including two ends, two rings slidably engaged on said ends of said barrel and rotated in concert with said barrel, said rings each including a plurality of ratchet teeth for engaging with said ratchet teeth of said ends of said follower respectively, said ratchet teeth of a first of said rings being arranged opposite to that of a second of said rings, and means for biasing said rings toward said follower and for biasing said ratchet teeth of said rings to engage with said ratchet teeth of said follower, said barrel being adapted to be rotated by said handle when said handle is rotated in an active direction, and said rings being adapted to be forced away from said follower against said biasing means when said handle is rotated in a reverse direction.

2. A ratchet screw driver according to claim 1, wherein said handle includes an open front and includes a cap secured to said front portion, said cap includes at least one cavity for engaging with a tool bit.

3. A ratchet screw driver according to claim 1 further comprising a member secured in said front portion of said handle, said front portion of said handle including at least one rib, said member including at least one groove for slidably engaging with said at least one rib and for allowing said member to be slidably engaged in said handle and for allowing said member to be rotated in concert with said handle.

4. A ratchet screw driver according to claim 3, wherein said at least one rib includes a notch, said cap includes a locking element for engaging with said notch and for securing said cap to said handle.

* * * * *